US005353761A

United States Patent [19]

Kalishman

[11] Patent Number: 5,353,761

[45] Date of Patent: Oct. 11, 1994

[54] ENGINE ENHANCER

[76] Inventor: Calvin Kalishman, 7034 Arbor View La., New Port Richey, Fla. 34653

[21] Appl. No.: 71,181

[22] Filed: Jun. 2, 1993

[51] Int. Cl.[5] ..... F02B 77/00

[52] U.S. Cl. ..... 123/198 A

[58] Field of Search ..... 123/198 A

[56] References Cited

U.S. PATENT DOCUMENTS 2,722,210 11/1955 Koonce ..... 123/198 A
3,530,842 9/1970 Brimer ..... 123/198 A
4,369,754 1/1983 Lofman ..... 123/198 A

*Primary Examiner*—Noah P. Kamen
*Attorney, Agent, or Firm*—Wolf, Greenfield & Sacks

[57] ABSTRACT

A system for enhancing the efficiency of an engine includes a container for holding an oil-based liquid. Intake tubes extend into the liquid and cause air to create turbulence in the liquid. This turbulence forms particles in the container above the level of the liquid which are carried out of the container as enriched air. The enriched air is combined with air from the crankcase prior to the PCV valve. The enriched air and the air from the crank case are then provided to the intake manifold of the engine.

10 Claims, 2 Drawing Sheets

ENGINE ENHANCER

BACKGROUND OF THE INVENTION

This invention relates to a system for enhancing the fuel efficiency in an engine.

In a typical gasoline powered, internal combustion engine, such as an automobile engine, a carburetor system or injection system controls the mixture of gasoline and air. Currently, there is a significant interest in finding ways to reduce gasoline consumption in automobiles to increase mileage per gallon of gasoline, thus saving money for the user, reducing pollutants to the environment, and reducing dependency on oil.

SUMMARY OF THE INVENTION

It is an object of the present invention to provide a system for enhancing the efficiency of an engine.

It is another object of the present invention to provide a system for enhancing the efficiency of an engine, where the system can be provided during manufacturing, or can be retrofitted.

It is yet another object of the present invention to provide a system for enhancing the fuel efficiency of an engine which is effective with carburetor systems or fuel injected systems.

To accomplish these and other objects, an apparatus is provided for use with an engine system which has a crankcase and an intake manifold. The apparatus has a container for holding a liquid, and an inlet conduit which extends into the container below the level of the liquid for allowing a gas, such as air, to enter the liquid in the container and for causing particles to form above the level of the liquid, thus forming an enriched air. An outlet conduit carries the enriched air from the container. The enriched air is combined with a gas from the crankcase and is provided to the intake manifold. The apparatus further includes a Tee which combines the enriched air and the gas from the crankcase before entering a PCV value. In a preferred embodiment, the container is about 4×4×5.75 inches and holds about 1 quart of liquid.

The invention also features a method for enhancing the efficiency of an engine system having a crankcase and an intake manifold. A container with a liquid and an inlet tube for a gas is provided to cause turbulence in the liquid which forms particles of the liquid above the level of the liquid. An enriched air is created which is combined with air from the crankcase. The combined enriched air and the air from the crankcase are provided to the intake manifold.

According to the present invention, an enhanced air flow is provided to the carburetion system without interfering with the operation of the PCV system. This system can be provided with the engine during manufacture, or may be retrofitted later, and can work with a carburetor or with a fuel injection system. The parts associated with the invention are generally inexpensive and easy to install.

BRIEF DESCRIPTION OF THE DRAWINGS

Other objects, features, and advantageous of the invention will now become apparent upon a reading of the following description of the preferred embodiment taken in conjunction with the accompanying drawings, in which.

DESCRIPTION OF THE PREFERRED EMBODIMENT

Figure 1:
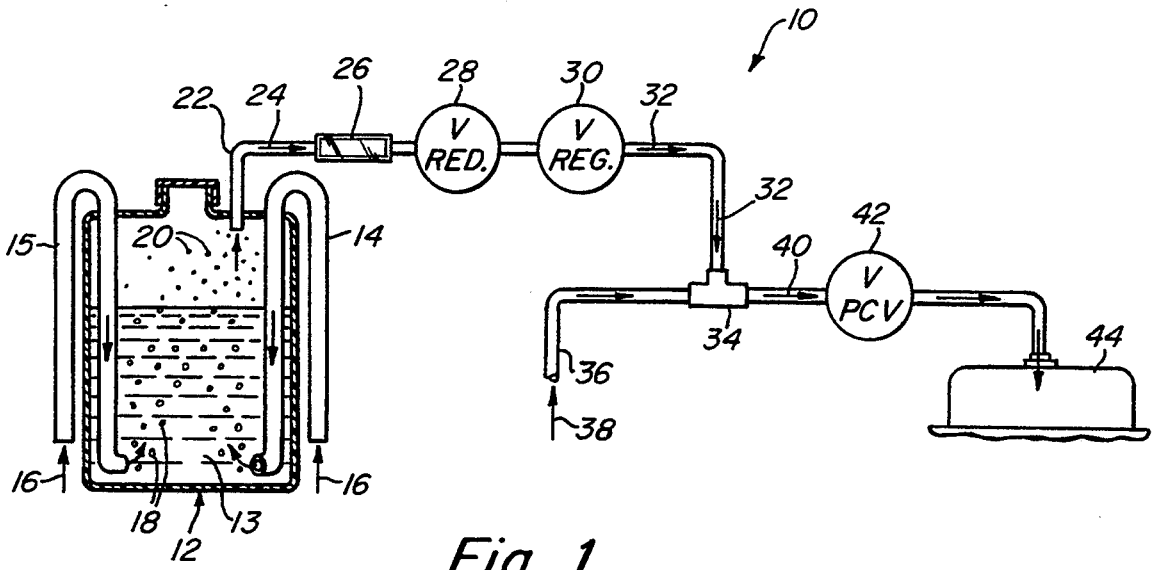
FIG. 1 is a pictorial representation of an embodiment of the present invention.

Referring to FIG. 1, an engine enhancing system 10 for an engine, such as an automobile engine, includes a container 12 for holding an oil-based liquid 13. Intake tubes 14, 15 enter the container 12 at the top, and extend to near the bottom of the container, below the level of liquid 13. Air flows into the container through the intake tubes 14, 15 along a path 16. The airflow causes turbulence within the liquid 13, in the container 12, causing bubbles 18 to form in the liquid 13, which in turn causes minute molecules or particles 20 of the oil-based liquid to form in the container 12 above the level of the liquid 13. The particles 20 are forced into an outlet tube 22 with air, following a path 24 of enriched air. The enriched air passes through a sight glass 26, a reducing valve or aperture 28, and a regulating valve 30. The enriched air then follows a path 32 into a Tee 34. The airflow effectively interrupts the normal tubal connection 36 from the crankcase ventilation system (not shown) to the intake manifold 30. Crankcase air, which has pollutants, follows a path 28; joins the enriched path 32 at the Tee 34; and the two air flows continue together along a path 40 through a PCV valve 42 and into an intake manifold 44 of the engine.

Thus, the oil based particles combine with the pollutant gas air flow from the crankcase ventilating system to form an enriched or enhanced air in the automobile carburetion system. By entering into the carburetion system as shown and described, the engine enhancing system 10 does not interfere with the operation of the PCV system, so it can be retrofitted to an existing model. Moreover, the system is effective in carburetor equipped engines, as well as in fuel injected systems.

Figure 2:
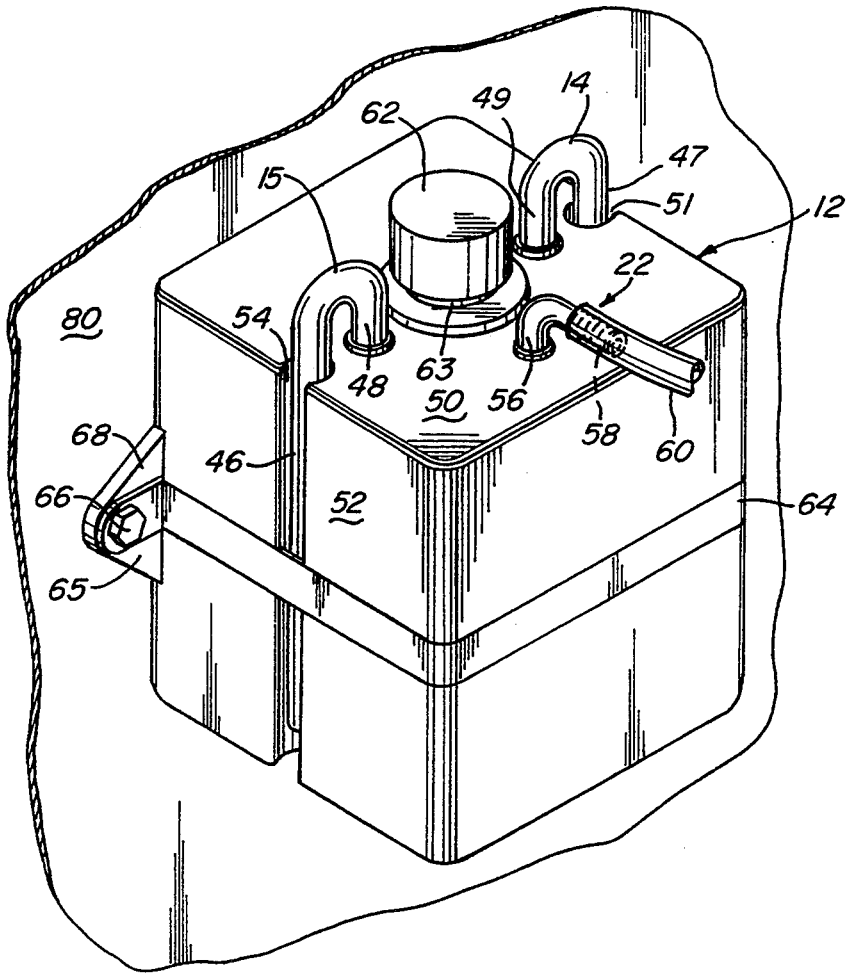
FIG. 2 is a perspective view of a container and tubing according to the present invention.

Referring to FIG. 2, the two intake tubes 14, 15 are U-shaped and have inner legs 48, 49 extending into the container 12 through openings in the top surface 50. The intake tube 15 has an outer leg 46 which extends down a side 52 of the container 12 through a channel 54. The intake tube 14 has a similar corresponding channel 51. The outlet conduit 22 has an L-shaped curved portion 56 which is mounted to the container at the top surface 50. At the outside end of the curved portion 56 is a fluted end portion 58 which allows a tube 60 to be easily attached or removed, while providing a tight connection when attached to the curved portion 56. At the center of top surface 50, a threaded cap 62 is screwed into a mating receiver 63. The cap 62 is easily removable to allow access to add to the liquid inside the container 12.

On three sides of the container 12, there is a groove into which a C-shaped band 64 is provided. At each end of the band 64 is an L-shaped portion 65. A bolt 66 passes through the portion 65 of the band 64 and a bracket 68. The bracket allows the container to be secured to a portion of a fender or a firewall 80 (FIG. 3).

Figure 3:
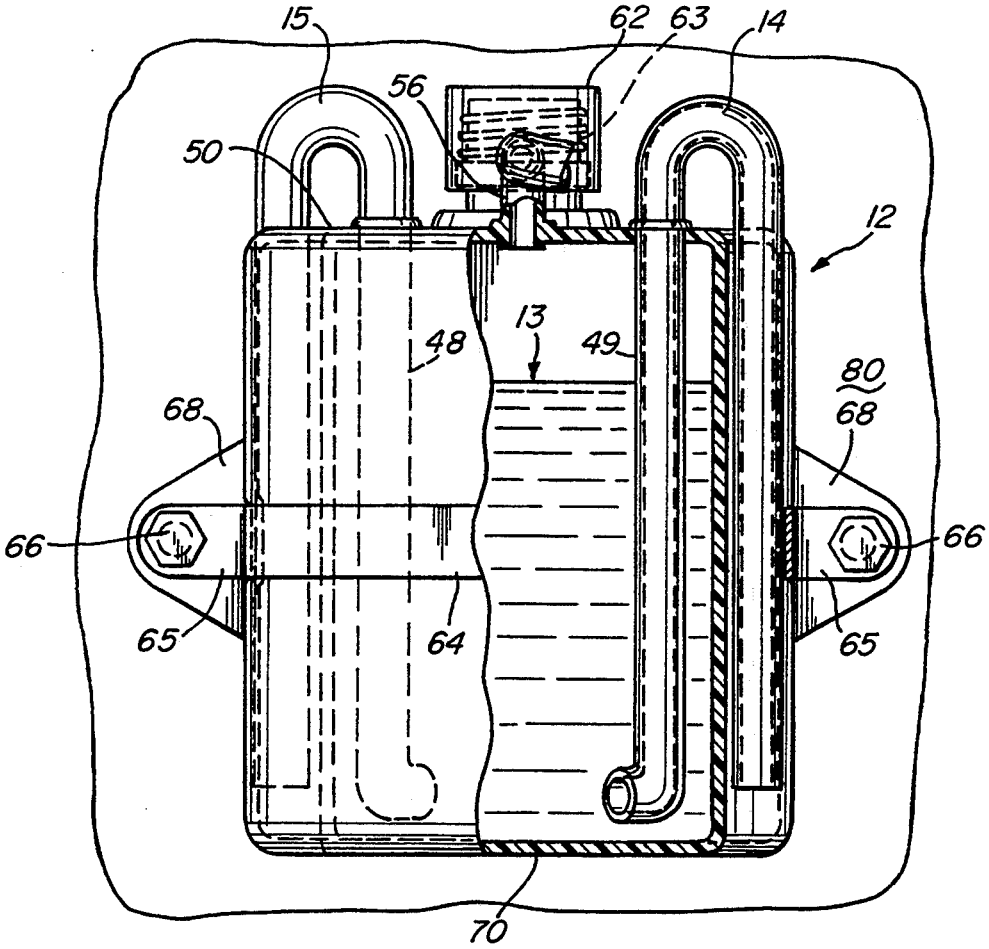
FIG. 3 is a partially cut-away side view of the tank of FIG. 2.
Figure 4:
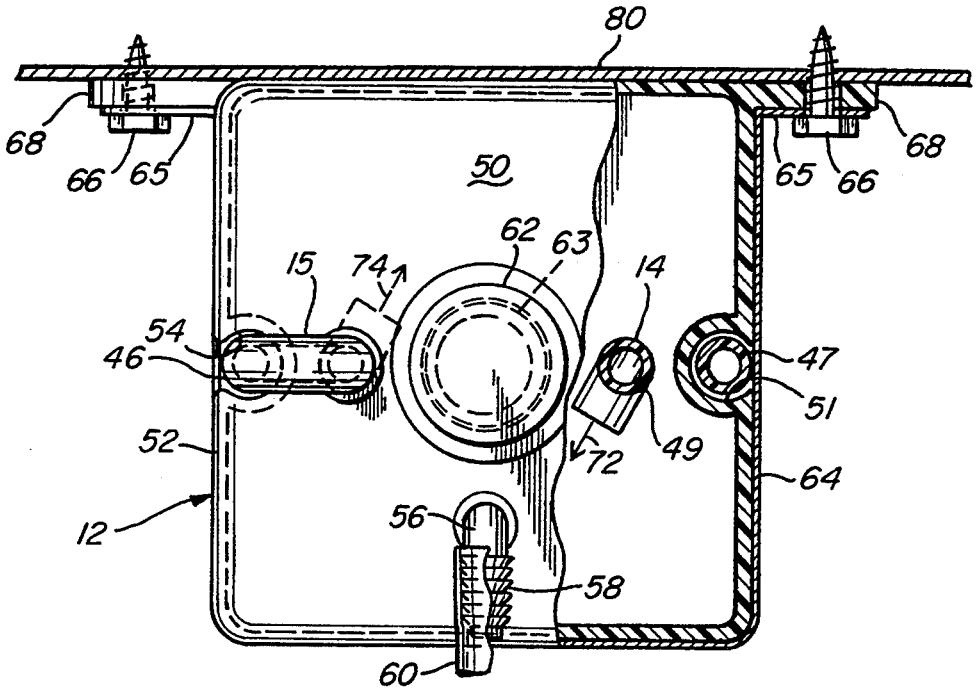
FIG. 4 is a partially cut-away plan view of the tank of FIG. 2.

Referring to FIGS. 3 and 4, the intake tubes 14, 15 each extend near the bottom 70 of the container 12. Each tube has a twist of about 45° with respect to the center of the container, so that the air inflow lines 72, 74 are parallel and in opposite directions. This arrangement causes swirling and turbulence in the liquid 13.

In a representative embodiment, the container 12 has a length of about 4 inches, a width of about 4 inches, a height of about 5.75 inches, and a wall thickness of at least about 3/32 inches. The container holds about 32 ounces of liquid and has marks on the exterior of the container to indicate the quantity of fluid. There is an indication of a suggested refill at a 16 ounce mark. Each of the outside corners of the container is rounded to have a radius of curvature of about 0.25 inch. The container is preferably a translucent material such as plastic.

The two U-shaped tubes 14, 15 have an outer diameter of 0.5 inches. The outer legs 46, 47 have a length of about 6 inches, and the inner legs 48, 48 have a length of about 6.25 inches. The inner legs 48, 49 extend about 1 inch outside and above the container and curve so that the center of the inner leg 48, 49 is about 0.75 inches from the center of the corresponding outer leg 46, 47.

The two brackets are about $\frac{7}{8}$ inches wide at the maximum width, and taper to the sides of the container. The bolt is mounted in a 5/16 inch diameter hole which is centered about 0.5 inches from the side of the container.

The outlet tube 56 curves about 0.5 inches from the top of the container and has a fluted portion for receiving 5/16 inch tubing.

The liquid in the container is preferably a top cylinder lubricating fluid, such as Marvel's Mystery Oil, a trademark of Marvel Oil Co., located in Westchester, N.Y. This particular fluid is generally available over the counter in many stores, as are other top cylinder lubricating fluids.

Tests have been performed which indicate that the described engine enhancing system 10 (FIG. 1) can contribute to reduced gasoline consumption. In one test, a 1993 Ford F150 with a V-8 engine covered 53 miles with 2.4 gallons of gasoline for 22 miles per gallon. Previously, the truck had been measured by the owner to get about 14–16 miles per gallon on the highway. In a second test, a 1987 Chevrolet Blazer with a V-6 engine travel 52 miles with 1.5 gallons for an efficiency of 34.6 miles per gallon. This vehicle had been previously measured by the owner to get 16 miles per gallon. In a third test, a 1991 Dodge Van motorhome with a V-8 engine covered 52 miles in 1.3 gallons, or 40 miles per gallon. Previously, the owner had measured the van to get 21 miles per gallon.

For each test, the device was installed and the vehicle was filled with regular gasoline. In each case, the tank was topped off first, then driven for the specified distance, and then topped off again in a similar manner to determine how much gasoline was used. While these tests were not conducted under strict scientific control methods, it should be apparent that even with a 20% undercount in the number of gallons used, the difference in miles per gallon is still rather significant.

These tests also indicate that the response of the engine improved. It is believed that the present invention provides additional benefits including a reduction in hydrocarbon emissions, lubrication of valve seats and guides, reduction in oil dilution and cylinder wall wear, and reduction in squelch area, thus improving efficiency.

Having now described a number of embodiments of the present invention, it should become apparent to those skilled in the art that numerous other embodiments and modifications are contemplated as falling within the scope of the present invention, as defined by the appended claims.

What is claimed is:

1. An apparatus for use with an engine system with a fuel injection system, the engine system having a crankcase and an intake manifold, said apparatus comprising:

a container for holding a liquid;

an inlet conduit extending into the container below the level of the liquid for allowing a gas to enter the liquid in the container and for causing particles to form above the level of the liquid forming an enriched air;

an outlet conduit for carrying the enriched air from the container;

a conduit for carrying gas from the crankcase;

means for combining the enriched air and the gas from the crankcase; and means, coupled to the combining means, for providing the combined enriched air and the air from the crankcase to the intake manifold without passing through a carburetor, the providing means including a PCV valve intermediate the combining means and the intake manifold.

2. The apparatus of claim 1 wherein the liquid is a top cylinder lubricating liquid.

3. The apparatus of claim 1 wherein the means for combining includes a Tee.

4. The apparatus of claim 1 wherein the container has dimensions of about 4×4×5.75 inches.

5. An apparatus for use with an engine system having a crankcase and an intake manifold, the apparatus comprising:

a container for holding a liquid, the container having side walls with recessed channels;

a plurality of inlet conduits extending into the container below the level of the liquid for allowing a gas to enter the liquid in the container and for causing particles to form above the level of the liquid forming an enriched air, wherein the inlet conduits have first legs and second legs, the first legs extending into the container and the second legs being disposed in respective recessed channels;

an outlet conduit for carrying the enriched air from the container;

a conduit for carrying gas from the crankcase;

means for combining the enriched air and the gas from the crankcase; and means, coupled to the combining means, for providing the combined enriched air and the air from the crankcase to the intake manifold.

6. The apparatus of claim 5 wherein the enriched air is provided to the intake manifold without passing through a carburetor.

7. The apparatus of claim 6 wherein the engine has a fuel injection system.

8. An apparatus for use with an engine system having a crankcase and an intake manifold, the apparatus comprising:

a container for holding a liquid;

a plurality of inlet conduits extending into the container below the level of the liquid for allowing a gas to enter the liquid in the container and for causing particles to form above the level of the liquid forming an enriched air;

an outlet conduit for carrying the enriched air from the container;

a conduit for carrying gas from the crankcase;

means for combining the enriched air and the gas from the crankcase; and means, coupled to the combining means, for providing the combined enriched air and the air from the crankcase to the intake manifold, wherein the inlet conduits are U-shaped, each conduit having a first leg in the container, a second leg outside the container, and a curved portion over the container, the second legs extending parallel to the first legs and adjacent the container.

9. The apparatus of claim 8 wherein the first legs each have an end which has a curved portion within the liquid.

10. An apparatus for use with an engine system having a crankcase and an intake manifold, the apparatus comprising:

a container for holding a liquid;

a plurality of inlet conduits extending into the container below the level of the liquid for allowing a gas to enter the liquid in the container and for causing particles to form above the level of the liquid forming an enriched air;

an outlet conduit for carrying the enriched air from the container;

a conduit for carrying gas from the crankcase;

means for combining the enriched air and the gas from the crankcase; and means for providing the enriched air and the air from the crankcase to the intake manifold, wherein the inlet conduits are U-shaped and have legs extending into the container, the legs having a curved end portion, wherein the curved portions are shaped to cause a circumferential swirling motion in the liquid about an axis parallel to the legs when gas enters the container through the inlet conduits.

* * * * *